US006722976B2

(12) United States Patent
Adams

(10) Patent No.: US 6,722,976 B2
(45) **Date of Patent: *Apr. 20, 2004**

(54) METHOD OF PLAYING GAME AND GAMING DEVICE WITH INTERACTIVE DRIVING GAME DISPLAY

(75) Inventor: William R. Adams, Las Vegas, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/144,578

(22) Filed: May 13, 2002

(65) Prior Publication Data

US 2002/0128055 A1 Sep. 12, 2002

Related U.S. Application Data

(63) Continuation of application No. 09/169,665, filed on Oct. 9, 1998, now Pat. No. 6,386,974.

(51) Int. Cl.[7] ..... A63F 9/24
(52) U.S. Cl. ..... 463/16
(58) Field of Search ..... 463/1, 6–7, 16–17, 463/20–23, 25–27, 30–32, 36–38, 46, 58–60; 273/138.1, 143 R

(56) References Cited

U.S. PATENT DOCUMENTS

| | | | |
|---|---|---|---|
| 3,281,149 | A | 10/1966 | Miller |
| 4,700,948 | A | 10/1987 | Okada |
| 4,805,907 | A | 2/1989 | Hagiwara |
| 4,871,171 | A | 10/1989 | Rivero |
| 4,906,005 | A | 3/1990 | Manabe |
| 5,167,413 | A | 12/1992 | Fulton |
| 5,205,555 | A | 4/1993 | Hamano |
| 5,259,616 | A | 11/1993 | Bergmann |
| 5,299,810 | A | 4/1994 | Pierce et al. |

(List continued on next page.)

FOREIGN PATENT DOCUMENTS

| | | |
|---|---|---|
| DE | 2938307 | 4/1981 |
| DE | 3700861 | 7/1988 |
| DE | 4014477 | 7/1991 |
| EP | 0333338 | 9/1989 |
| FR | 1474617 | 3/1967 |
| GB | 1242298 | 8/1971 |
| GB | 2066991 | 7/1981 |
| GB | 2072395 | 9/1981 |
| GB | 2083936 | 3/1982 |
| GB | 2084371 | 4/1982 |
| GB | 2096376 | 10/1982 |
| GB | 2153572 | 8/1985 |
| GB | 2170938 | 8/1986 |
| GB | 2182186 | 5/1987 |
| GB | 2191030 | 12/1987 |
| GB | 2201821 | 9/1988 |
| GB | 2202984 | 10/1988 |
| GB | 2242300 | 9/1991 |
| JP | 5131044 | 5/1993 |

OTHER PUBLICATIONS

Bueschel, Richard M., "An Illustrated Price Guide to the 100 Most Collectible Trade Stimulators," 1978, pp. 21, 29,83.
Bueschel, Richard M., "Slots 1," 1978, pp. 136, 142.
Geddes, Robert N., "Slot Machines on Parade," Oct. 1980, p. 128.

(List continued on next page.)

*Primary Examiner*—Kim Nguyen
(74) *Attorney, Agent, or Firm*—Marshall, Gerstein & Borun LLP

(57) ABSTRACT

Methods of playing games and gaming devices useful for playing games whereby the gaming device comprises a first gaming unit for displaying a randomly selected combination of indicia and a mechanism for generating at least one signal corresponding to the first gaming unit. The gaming device also comprises a second gaming unit for displaying an interactive driving video game whereby the second gaming unit is operatively connected to the first gaming unit and the second gaming unit becomes actuable or is activated in response to the signal generated by the first gaming unit.

14 Claims, 2 Drawing Sheets

U.S. PATENT DOCUMENTS 5,342,049 A 8/1994 Wichinsky et al.
5,344,145 A 9/1994 Chadwick et al.
5,486,005 A 1/1996 Neal
5,511,781 A 4/1996 Wood et al.
5,628,684 A 5/1997 Bouedec
5,664,998 A * 9/1997 Seelig et al. ..... 463/20
5,695,402 A 12/1997 Stupak
5,707,285 A 1/1998 Place et al.
5,722,891 A 3/1998 Inoue
5,772,509 A * 6/1998 Weiss ..... 463/16
5,823,874 A 10/1998 Adams
5,848,932 A 12/1998 Adams
5,882,261 A 3/1999 Adams
5,911,418 A 6/1999 Adams
5,993,315 A * 11/1999 Strider et al. ..... 463/1
6,050,895 A 4/2000 Luciano, Jr. et al.
6,089,978 A 7/2000 Adams
6,135,884 A * 10/2000 Hedrick et al. ..... 463/20
6,203,429 B1 * 3/2001 Demar et al. ..... 463/20
6,386,974 B1 * 5/2002 Adams ..... 463/16

OTHER PUBLICATIONS

Advertisement, Bally Distributing Company, Double or Nothing, Model 1083, Ch. 11, 1975–1984, p. 267.

Fey, Marshall, "Slot Machines," 1983, p. 126, 150.

Intergame Magazine, Jun. 1995, cover and pp. 91, 101.

* cited by examiner

METHOD OF PLAYING GAME AND GAMING DEVICE WITH INTERACTIVE DRIVING GAME DISPLAY

This is a continuation of U.S. application Ser. No. 09/169,665, filed Oct. 9, 1998, now U.S. Pat. No. 6,386,974.

The present invention is directed to methods of playing wagering games and gaming devices comprising a second gaming unit for displaying a randomly determined interactive video driving game which also allows a player to interact with the gaming device.

BACKGROUND OF THE INVENTION

Games of chance have been enjoyed by people for thousands of years and have enjoyed widespread popularity in recent times. Many people enjoy playing variations of games that they have not previously played. Playing new variations of games adds to the excitement of this recreational activity, particularly when some form of gaming is involved. As used herein, the terms "gaming" and "gaming devices" are used to indicate that some form of wagering is involved, and that players must make wagers of value, whether with actual currency or some equivalent of value, e.g., token or credit.

Players involved in games of wagering often enjoy new games or variations of old games with relatively simple rules that can be readily learned by a beginner or casual player. Variations to a game with respect to the method of wagering and the ability to increase winnings attracts more players and is highly desired in the industry. The ability to increase winnings where risk is involved based on the selection of a possible random outcome is also highly desired. Therefore, it is desirable to offer players new variations of games that allow players additional opportunities to increase winning payouts. It would be particularly desirable to provide opportunities to increase winning payouts and also allow a player to interact with a gaming device in the form of a video game. For example, offering a player the opportunity to play a video game and increase his winnings by playing such a video game is also desirable.

SUMMARY OF THE INVENTION

Various embodiments of the present invention comprise gaming devices having a first gaming unit for displaying randomly selected indicia and means for generating a signal corresponding to some signal from the first gaming unit, for example, input by the player, the randomly displayed indicia, or some interim event occurring during the play of the first gaming unit. The gaming device also includes a secondary unit for displaying an interactive driving video wherein the second gaming unit is connected to the first gaming unit and becomes operational in response to a signal generated by the first gaming unit. According to one embodiment, a first payout indicator is responsive to the first gaming unit of the gaming device, and a second payout indicator is responsive to the second gaming unit.

In preferred embodiments of the present invention, the displayed indicia of the first gaming unit may be in the form of reels, indicia of reels, playing cards, indicia of playing cards, dice, indicia of dice, numbers, indicia of numbers, and combinations thereof.

DETAILED DESCRIPTION

The various embodiments of the present invention are designed to provide added excitement to a gaming device in order to increase the enjoyment of players and to serve as an added attraction to potential players. One embodiment of the present invention provides a novel concept to gaming wherein a player's award on a primary game may be changed or supplemented by a secondary unit which comprises an interactive video driving display, but which has at least one outcome which is randomly determined.

Figure 1:
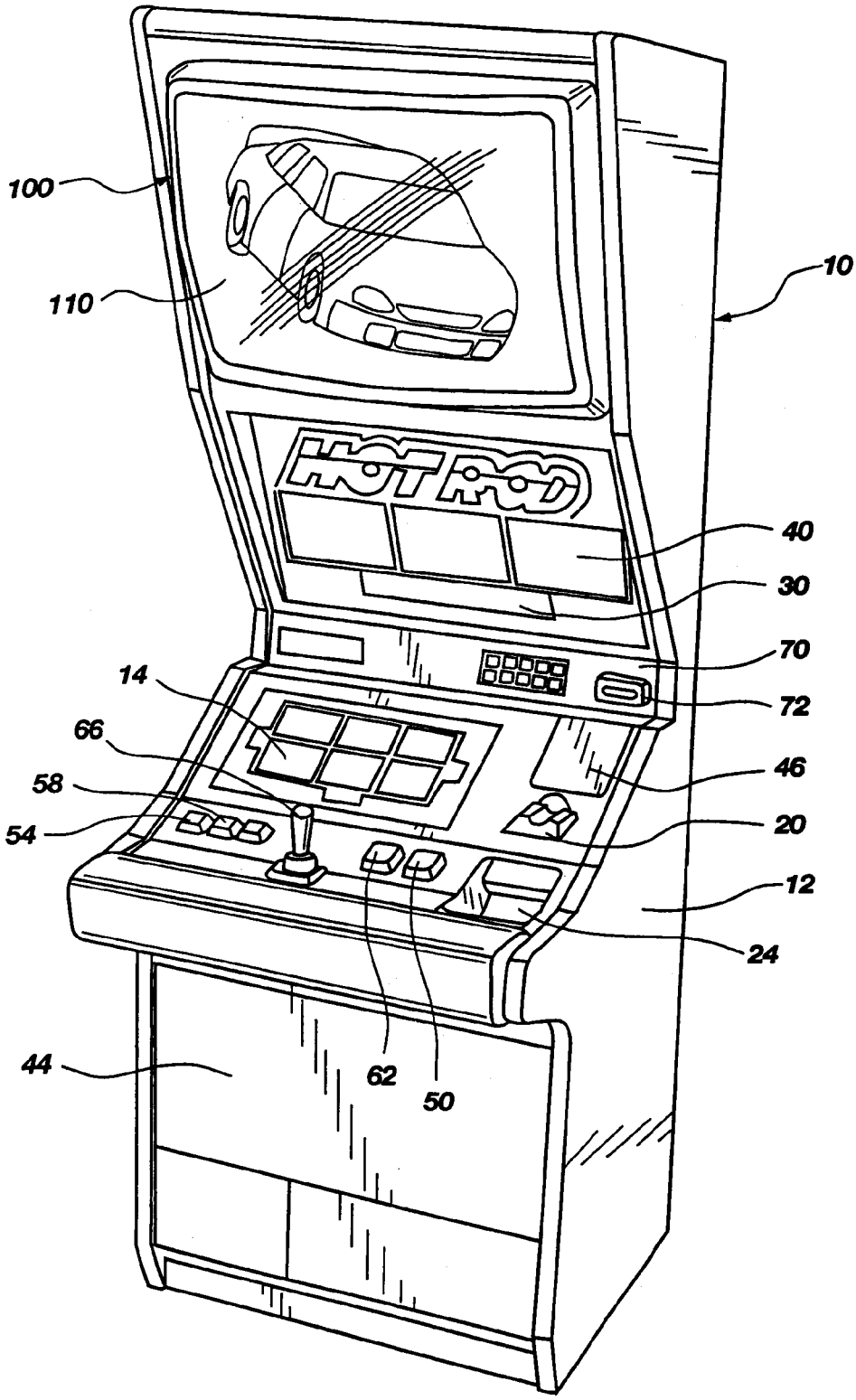
FIG. 1 depicts a typical configuration of a slot machine version of the present invention.

One embodiment of the present invention, illustrated in FIG. 1, shows a gaming device 10 comprising a three-reel slot 14. Three-reel slot 14 comprises three rotatable reels, each of which comprises a plurality of indicia on the periphery thereof. Gaming device 10 further includes instructions 44 and video instructional prompt 46, for playing gaming device 10.

Total credit window 70 displays a player's available credit and wager amount window 72 displays a player's wager. Gaming device 10 comprises housing 12 which encases components, as known in the art, to facilitate operation of gaming device 10. Gaming device 10 further includes a second gaming unit comprising an interactive video display 100 for a driving game that is activated or becomes activatable in response to a signal from the first gaming unit.

A player may place a wager to play a game through coin or token acceptor 20 and collect winnings through coin receptacle 24. Gaming device 10 further comprises a first payout indicator 30 that indicates to a player that a winning preselected combination of indicia has been displayed. A second payout indicator 40 indicates that a player has obtained a successful or losing outcome with the interactive video game and such play has or has not resulted in a winning payout. Gaming device 10 receives input for play through "SPIN" button 50, "CANCEL" button 54, "BET ONE" button 58, "BET MAX" button 62 and joystick 66.

As illustrated in FIG. 1, gaming device 10 comprises a game for playing a three-reeled slot game, as shown by the three-reeled slot indicia 14. To begin play, a player places coins or tokens in coin or token acceptor 20. The total amount of the coins or tokens is displayed in total credit window 70. A player then inputs a wagering amount using "BET ONE" button 58 or "BET MAX" button 62, as represented in wager amount window 72. Subsequent to wagering, a player is then prompted, through video instructional prompt 46, to actuate "SPIN" button 50 to activate rotation of the of three-reeled slots 14. Gaming device 10 subsequently generates randomly selected indicia as displayed on rotatable reels 14. The displayed indicia of rotatable reels 14 is compared to a preselected winning combination of rotatable reels (not shown, but contained within housing 12 as is commonly known in the art). If the displayed indicia 14 does not match a pre-selected winning combination of indicia, a player may: 1) cash out and collect the remaining available credit through coin receptacle 24; or 2) play again and wager from the remaining available credit displayed in total credit window 70.

As illustrated in FIG. 1, gaming device 10 includes a second gaming unit comprising an interactive video display 100 which displays a video driving game. The video driving game, in this embodiment, prompts a player to maneuver a vehicle through a driving course, preferably the Las Vegas Strip. A player maneuvers the vehicle displayed from video screen 110 by manually manipulating joystick 66. Joystick 66 and the corresponding electronics and appropriate software which are programmed to effect use of joystick 66 and play of the video driving game displayed from video screen 110 of this invention are included within housing 12 of gaming device 10. The particular electronic elements and software programming format could be readily assembled and performed by one skilled in the art in light of the present description provided herein; therefore, further detailed explanation of the specific electronics and programming is not provided herein.

The path, through which a player maneuvers with joystick 66, is intended to have various random events which are beyond the player's control. Therefore, though a player may select which path to maneuver a vehicle as displayed on video screen 110, the player's skill does not determine the outcome of the secondary game. For example, a typical game scenario displayed from video screen 110 involves a vehicle coming to an intersection where randomly controlled events happen. The vehicle could get into an accident, could be engulfed in lava from an erupting volcano, or could have the Stratosphere Tower fall down on top of him (as seen through a sun roof). Mishaps such as these would result in destruction of the vehicle and/or have a negative effect on a player's winning payout.

In the alternative, if a player is permitted to maneuver the vehicle safely down the Las Vegas strip, the player's winning payout will be affected. According to one aspect of the present invention, payouts increase as the player gets further down Las Vegas Boulevard. The player may also be provided the option of stopping his "trip" at any time and taking the payout corresponding to his present location. The awards can be used to change an award on the base game by increasing it by displayed amounts, multiplying it by a multiplier, or both. Alternatively, an independent award/payout can be provided by the secondary game.

Figure 2:
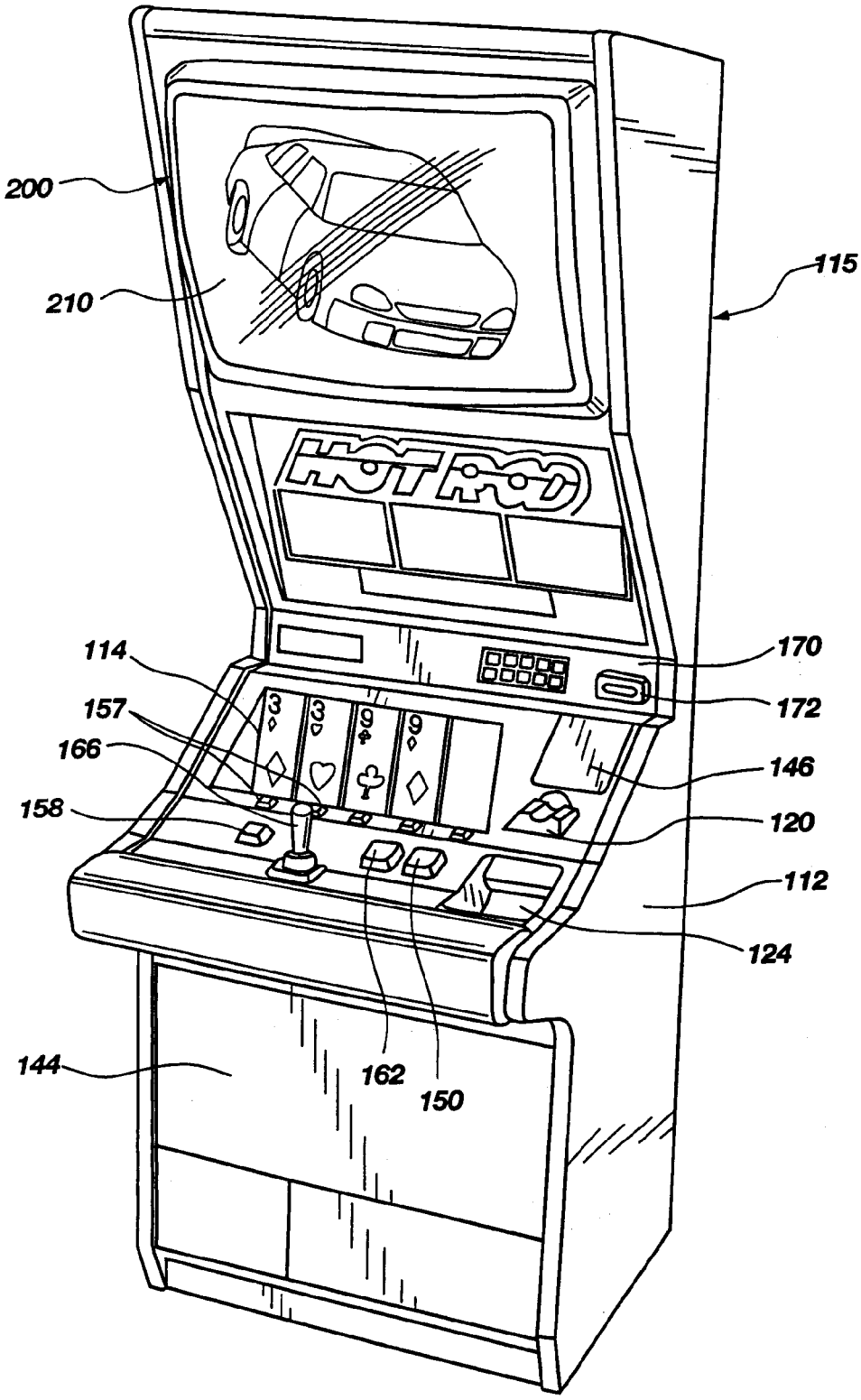
FIG. 2 depicts a typical configuration of a video poker game version of the present invention.

In FIG. 2, a preferred embodiment of the present invention shows gaming device 115 comprising a video poker game as the first gaming unit. Video screen 114 displays an indicia of playing cards. Gaming device 115 also comprises housing 112 which encases components to facilitate operation of gaming device 115. Similar to the features illustrated in FIG. 1 for gaming device 10, gaming device 115 also comprises instructions 144, video instructional prompt 146, total credit window 170, wager amount window 172, coin or token acceptor 120 and coin receptacle 124. Gaming device 115 also includes a second gaming unit comprising an interactive video driving game display 200, similar to the interactive video display 100 illustrated and described in FIG. 1.

A player will be prompted from video instructional prompt 146, to enter a wagering amount through coin and/or token acceptor 120, the total being displayed in total credit window 170. A player will then be prompted from video instructional prompt 146 to place a wagering amount for that game. A player may then select the amount of the wager for that game, using "BET ONE" button 158 or "BET MAX" button 162, from the total amount of credits as displayed in total credit window 170. This amount of wager will be displayed in wager amount window 172. Upon selecting a wagering amount, the player will then be prompted to activate the "DEAL" button 150, which activates gaming device 115 to display indicia of playing cards on video screen 114. After the initial display of indicia of playing cards, buttons 157 allow a player to hold or discard any of the indicia of cards displayed from video screen 114. A player will then actuate "DEAL" button 150 to display new cards for those indicia of playing cards discarded.

Similar to the manner of playing the three-reeled slot game, shown in FIG. 1, the video poker game illustrated in FIG. 2 displays an indicia of playing cards from video screen 114 that is compared to a preselected winning combination of indicia of playing cards (not shown, contained within housing 112 as is commonly known in the art). If the displayed indicia displayed from video screen 114 does not match a preselected winning combination of indicia, a player may: 1) cash out and collect the remaining available credits through coin receptacle 124; or 2) play again and wager from the remaining available credits displayed in total credit window 170.

Upon generation of a winning combination of indicia, a player may choose: 1) to cash out and collect the winnings; 2) add to the winnings; or 3) play the interactive video game 200.

Similar to the gaming device of FIG. 1, gaming device 115 includes a second gaming unit comprising an interactive video display of a driving game. The video driving game, prompts a player to maneuver a vehicle through a driving course, preferably the Las Vegas Strip. Similar to FIG. 1, a player maneuvers the vehicle displayed from video screen 210 by manually manipulating joystick 166. The corresponding electronics and appropriate software which are programmed to allow use of joystick 166 and play of the video driving game displayed on screen 210 are included within housing 112 of gaming device 115. The manner of play effectuated by the video driving game of gaming device 115 is similar to the method used for gaming device 10 in FIG. 1. If the randomly determined result of the video driving game is the destruction of the vehicle, preferably a negative effect is imparted to the player's winning payout. In the alternative, if a player is permitted to maneuver the vehicle safely down the Las Vegas Strip, the player's winning payout will be increased.

What is claimed:

1. A method of operating a gaming apparatus, the method comprising:

receiving a wager;

generating a first, random game outcome;

displaying a first image according to the first game outcome;

determining a second, random game outcome according to the first game outcome;

receiving a plurality of player inputs;

varying a second image in accordance with the plurality of player inputs for a time period; and varying the second image in accordance with the second, random game outcome irrespective of the player input after the time period has elapsed.

2. The method according to claim 1, comprising:

displaying a first image according to the first game outcome and representative of a game selected from the group of games consisting of slots and video poker.

3. The method according to claim 1, comprising:

determining a second, random game outcome if the first, random game outcome is a winning outcome.

4. The method according to claim 1, comprising:

varying a second image representative of a vehicle and a road in accordance with the plurality of player inputs for a time period, the vehicle maneuvering along the road in accordance with the plurality of player inputs.

5. The method according to claim 1, comprising:

varying a second image representative of a vehicle and a road in accordance with the plurality of player inputs for a time period, the vehicle maneuvering along the road in accordance with the plurality of player inputs and the distance the vehicle travels along the road in accordance with the second, random outcome.

6. The method according to claim 5, wherein the distance the vehicle travels along the road is directly related the second, random outcome.

7. The method according to claim 1, comprising:

providing a first award according to the first, random game outcome; and providing a second award according to the second, random game outcome, the second award comprising at least one of an additional amount to be added to the first award, a multiplier to be used to multiply the first award, an additional amount to be added to the first award and a multiplier to be used to multiply the first award, and an independent award.

8. A method of operating a gaming apparatus, the method comprising:

receiving a wager;

generating a first, random game outcome;

displaying a first image according to the first game outcome;

determining a second, random game outcome according to the first game outcome;

receiving a player input;

varying a second image in accordance with the player input during a time period having a duration, the duration of first time period in accordance with the second, random game outcome; and varying the second image in accordance with the second, random game outcome irrespective of the player input after the time period has elapsed.

9. The method according to claim 8, comprising:

displaying a first image according to the first game outcome and representative of a game selected from the group of games consisting of slots and video poker.

10. The method according to claim 8, comprising:

determining a second, random game outcome if the first, random game outcome is a winning outcome.

11. The method according to claim 8, comprising:

varying a second image representative of a vehicle and a road in accordance with the player input for a time period having a duration, the vehicle maneuvering along the road in accordance with the player input and the duration in accordance with the second, random game outcome.

12. The method according to claim 8, comprising:

varying a second image representative of a vehicle and a road in accordance with the player input for a time period having a duration, the vehicle maneuvering along the road in accordance with the player input and the duration of the time period and the distance the vehicle travels along the road in accordance with the second, random game outcome.

13. The method according to claim 12, wherein the distance the vehicle travels along the road is directly related to the second, random outcome.

14. The method according to claim 8, comprising:

providing a first award according to the first, random game outcome; and providing a second award according to the second, random game outcome, the second award comprising at least one of an additional amount to be added to the first award, a multiplier to be used to multiply the first award, an additional amount to be added to the first award and a multiplier to be used to multiply the first award, and an independent award.

* * * * *

UNITED STATES PATENT AND TRADEMARK OFFICE

CERTIFICATE OF CORRECTION

PATENT NO. : 6,722,976 B2
DATED : April 20, 2004
INVENTOR(S) : William R. Adams

It is certified that error appears in the above-identified patent and that said Letters Patent is hereby corrected as shown below:

Column 5,
Line 6, cancel "directly related the" and insert -- directly related to the --.

Signed and Sealed this

Twenty-sixth Day of October, 2004

JON W. DUDAS
*Director of the United States Patent and Trademark Office*